US005782020A

United States Patent [19]

Shumaker

[11] Patent Number: 5,782,020

[45] Date of Patent: Jul. 21, 1998

[54] METHOD AND EQUIPMENT FOR SIMULTANEOUS EXCAVATION AND LAND REFILL WITH MINIMUM OPERATING LABOR

[76] Inventor: L. Wade Shumaker, Rt. 2, Box 81DS, Manor, Tex. 78653

[21] Appl. No.: 747,524

[22] Filed: Nov. 13, 1996

[51] Int. Cl.[6] ..... E02F 3/00

[52] U.S. Cl. ..... 37/466; 37/411; 37/373; 299/30; 198/301

[58] Field of Search ..... 37/466, 142.5, 37/197, 305, 411, 442, 397, 373, 380, 394; 299/7, 8, 30; 701/50; 193/25 E, 24; 198/300, 301, 310, 311, 315

[56] References Cited

U.S. PATENT DOCUMENTS

| | | | |
|---|---|---|---|
| 2,754,015 | 7/1956 | Lee . | |
| 3,308,974 | 3/1967 | Rosenbaum . | |
| 3,522,670 | 8/1970 | Flipse et al. | 299/8 X |
| 3,672,725 | 6/1972 | Johnson | 299/8 |
| 3,731,975 | 5/1973 | Lindelof | 299/8 |
| 3,939,958 | 2/1976 | Pyles . | |
| 3,999,313 | 12/1976 | Andrews | 299/8 X |
| 4,242,036 | 12/1980 | Slaght . | |
| 4,301,910 | 11/1981 | Price | 37/142.5 X |
| 4,343,389 | 8/1982 | Ponstein | 37/142.5 X |
| 4,783,171 | 11/1988 | Zimmerman . | |
| 5,009,548 | 4/1991 | Falbo et al. | 37/142.5 X |
| 5,470,175 | 11/1995 | Jensen et al. . | |
| 5,540,003 | 7/1996 | Osadchuk | 37/142.5 |

FOREIGN PATENT DOCUMENTS

| | | | |
|---|---|---|---|
| 2027294 | 2/1980 | United Kingdom | 299/30 |
| 1592032 | 7/1981 | United Kingdom . | |

*Primary Examiner*—Terry Lee Melius
*Assistant Examiner*—Victor Batson
*Attorney, Agent, or Firm*—Joseph F. Long

[57] ABSTRACT

An excavator with a wireless controlled hopper-spreader allows a single operator to strip off topsoil and spread the stripped off soil more or less evenly after a mineable substance such as gravel is removed. The hopper-spreader uses about a fifty foot conveyor and may be totally operated by an operator in the excavator cab. This combination may be both faster and cheaper than a normal dragline operation.

2 Claims, 5 Drawing Sheets

METHOD AND EQUIPMENT FOR SIMULTANEOUS EXCAVATION AND LAND REFILL WITH MINIMUM OPERATING LABOR

BACKGROUND

Commonly, in recent years, many surface excavations require refilling the excavated soil to an approximately smooth surface before the job is completed. From the contractors viewpoint use of the minimum amount of labor is quite desirable. This patent is designed to allow one man to both run the excavator and to oversee the operation of a self propelled remotely guided hopper-spreader with the hopper-spreader close enough to receive material from the excavator. The mobile hopper-spreader with the excavator is designed to take the place of some dragline operations and is both cheaper and faster. The mobile hopper-spreader includes wireless receivers and mechanisms to allow remotely starting and stopping the hopper spreader or receiving vehicle; to allow turning to the right or left or to back up the receiving vehicle; to adjust the speed of the receiving vehicle; to stop or start a vibrator mounted on the hopper on the receiving vehicle; to allow raising or lowering a conveyor mounted with a beginning end under said hopper; a light activated system mounted on the excavator to broadcast a stop signal, a slow down signal, or a speed-up signal to a receiver on the receiving vehicle with the receiver communicating with equipment to carry out the indicated action.

A TV camera mounted on a top part of the hopper-spreader frame to broadcast a wide angle picture to a receiver mounted on a control panel in said excavator allows the operator of the excavator to monitor visually the operation of the receiving vehicle.

SUMMARY OF THE INVENTION

The invention may be described as the lowest cost and minimum labor system to remove over burden from a mineable substance such as gravel. More specifically the equipment includes an excavator equipped with an operator control panel allowing an operator to receive a visual picture of a top view of the operation of a specially designed hopper-spreader with a control panel on the excavator having a group of operator controlled buttons wirelessly interacting with a receiver control panel on the hopper-spreader. The receiver control panel receives messages and interacts with output controls and equipment on the hopper-spreader to do a minimum of the following actions:

1. start an internal combustion motor to operate a hydraulic system that furnishes power for each operation of said hopper-spreader,
2. stop said motor,
3. start a forward motion of said hopper-spreader,
4. back up said hopper-spreader,
5. turn said hopper-spreader hard left,
6. turn said hopper-spreader hard right,
7. Increase forward speed of said hopper-spreader,
8. decrease forward speed of said hopper-spreader,
9. turn said hopper-spreader about 10 degrees left,
10. turn said hopper-spreader about 10 degrees right,
11. lowering a conveyor on said hopper-spreader,
12. raise said conveyor,
13. stop said conveyor,
14. adjust a counter weight mounted on said hopper-spreader to prevent tipping of said hopper-spreader.

These actions allow the operator of the excavator to completely control the hopper spreader while remaining in position in the excavator; thus allowing one man to operate both major pieces of equipment with very little extra time more than is necessary to operate the excavator itself. The hopper-spreader has override controls to allow the excavator operator to manually position the hopper-spreader when he wishes.

DETAILED DESCRIPTION OF THE INVENTION

The invention may best be described from the drawings.

Figure 1:
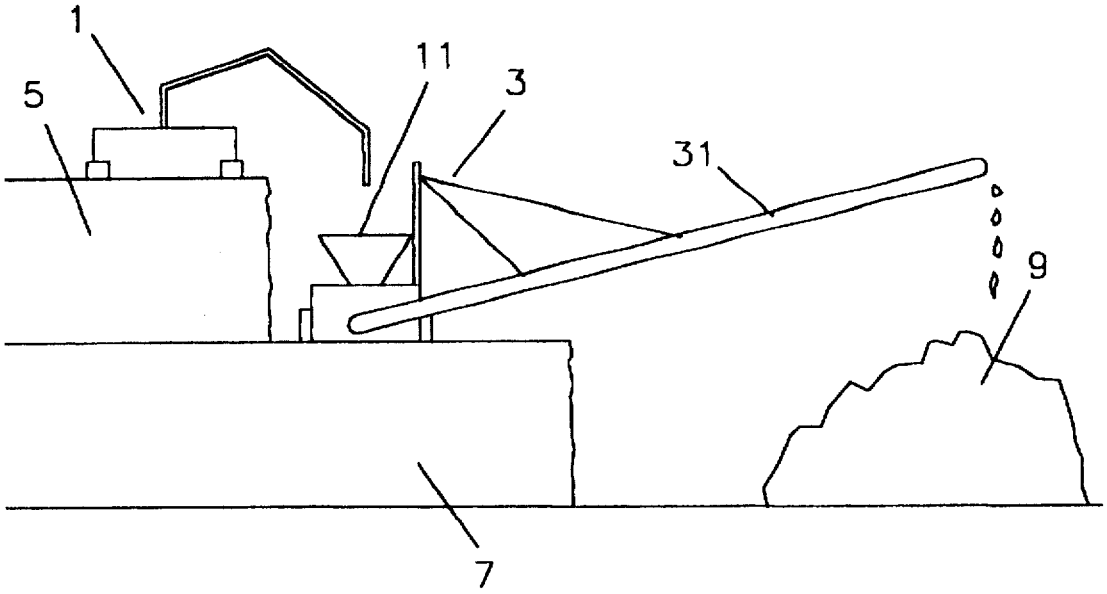
FIG. 1 shows a top view of an excavator and relative position of the self propelled, wireless controlled hopper-spreader in an use position.

In FIG. 1 we show a rear view of an excavator 1 sitting on topsoil 5. The excavator 1 removes soil in front of the excavator and turns to deposit the removed soil into a remote controlled hopper-spreader 3. In this case we've shown the mineable substance to be a gravel bed 7. The hopper-spreader 3 moves in tandem with the excavator 1 and travels on top of the gravel bed 7. The gravel is removed in a separate operation and a conveyor 31 which may be about 50 foot long is filled from hopper 11 and discharges to form a windrow of topsoil 9.

An excavator half the size of a dragline can move more than twice the amount of material at a cheaper operating cost.

Figure 2:
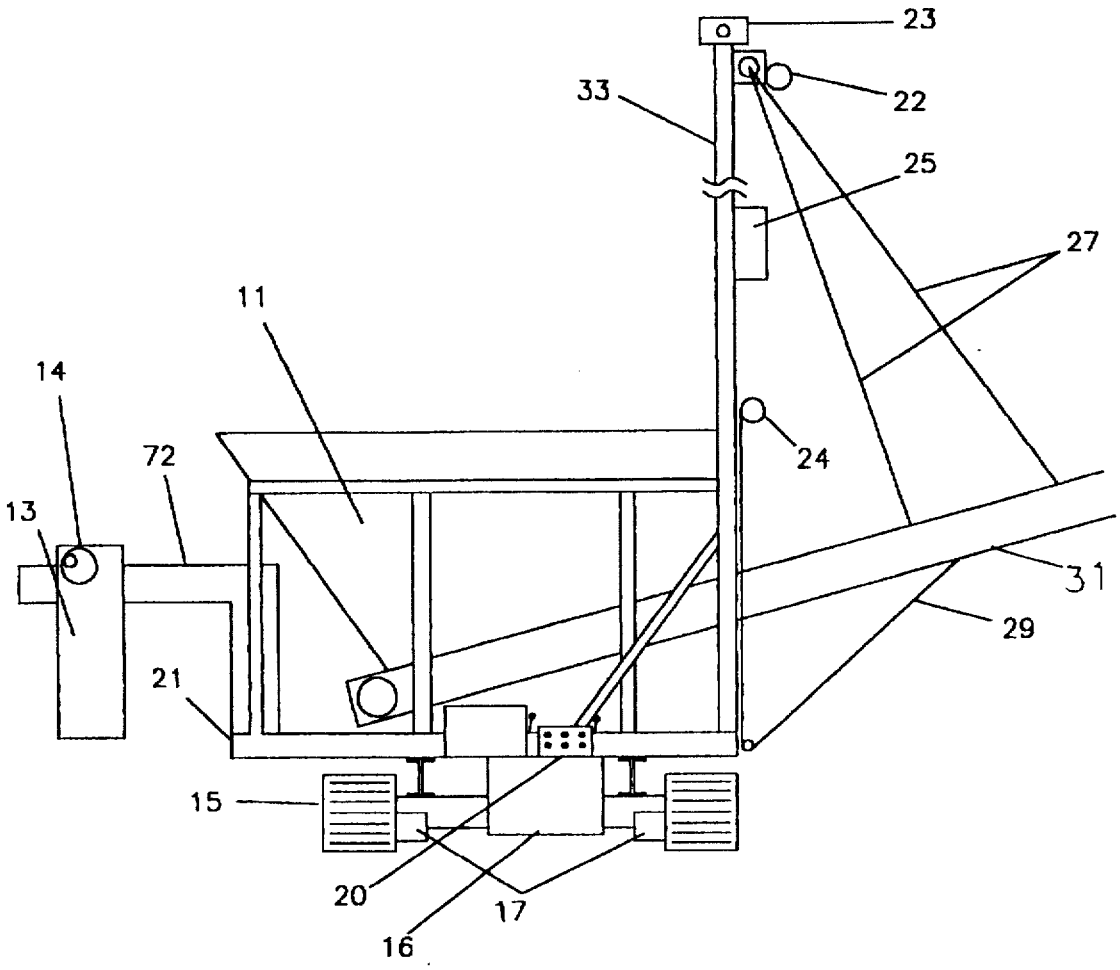
FIG. 2 shows a rear end view of the hopper-spreader.

In FIG. 2 a rear end view of the hopper-spreader or receiver is shown. Hopper 11 is V shaped with a lengthwise rectangular opening above a beginning end of belt conveyor 31 . The unit is hydraulically driven and operated with an internal combustion engine and hydraulic pump assembly furnishing hydraulic power. Rotatable tracks 15 are driven by hydraulic motors 17. Counter weight 13 is movably mounted on an L shaped counter weight support 72 to the I beam support 21 forming the frame of the hopper-spreader and is movable as necessary by counter weight motor drive 14 to balance the weight of conveyor 31.

Conveyor support rack 33 is integrally attached to the hopper-spreader frame 21 and may be from 10 to 14 feet tall. Camera 23 has a wide angle lens with continous picture output to TV screen 46, FIG. 5. A capstan type hydraulically driven cable winder 22 raises or lowers conveyor 31 using adjustable support cables 27. A similar type capstan winder 24 may tighten or loosen stabilizing cable 29.

Figure 5:
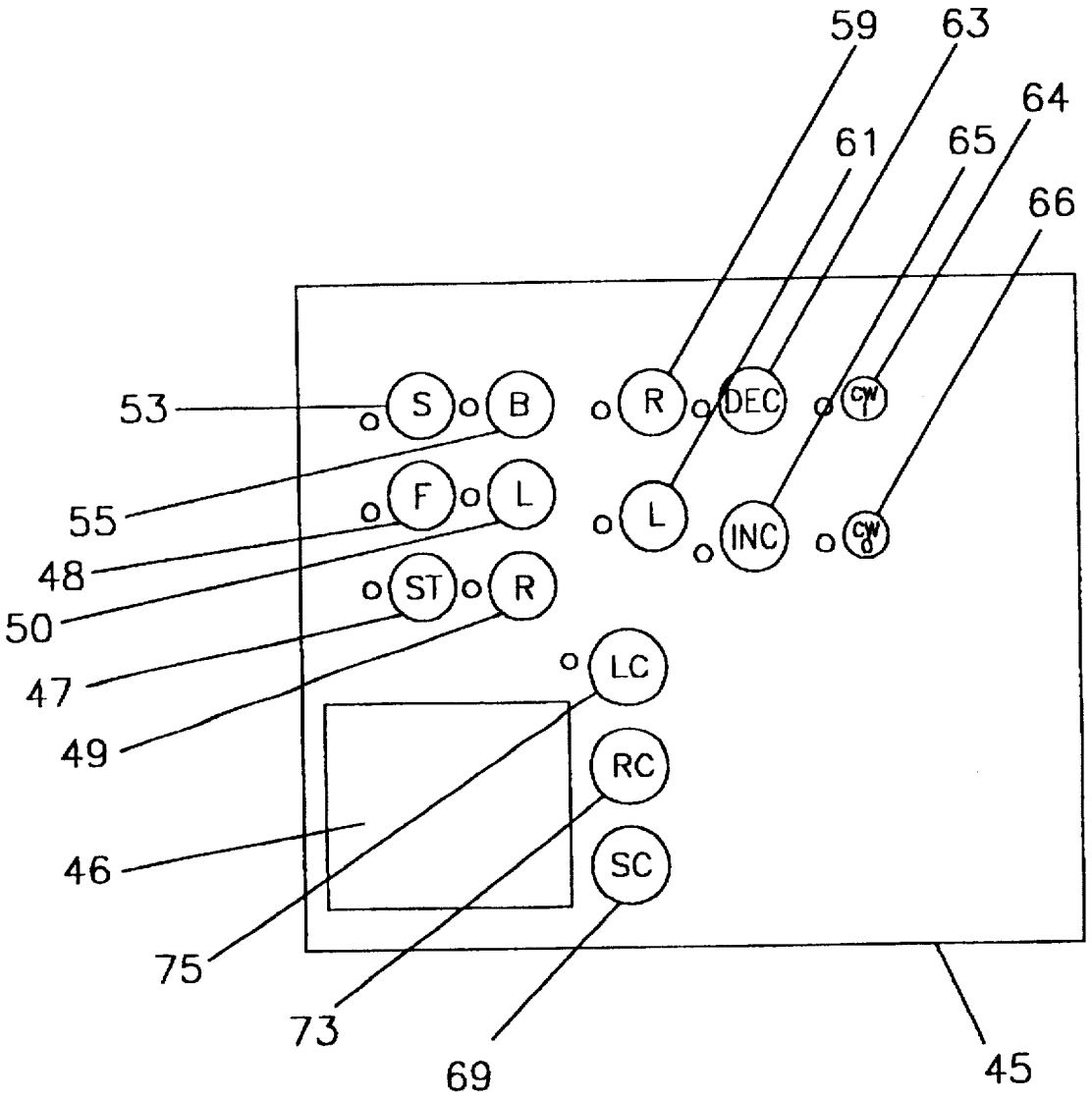
FIG. 5 shows the control panel that mounts near the operators seat on the excavator.

Box 25 contains controls to interact with control panel 45, FIG. 5 mounted in excavator 1, FIG. 1.

Control panel 20 has manual over-ride controls to allow manual operation to stop, start, back up, move forward or to turn the hopper-spreader unit. Step 16 allows an operator to stand on the moving unit when necessary to use the manual over-ride controls.

Figure 3:
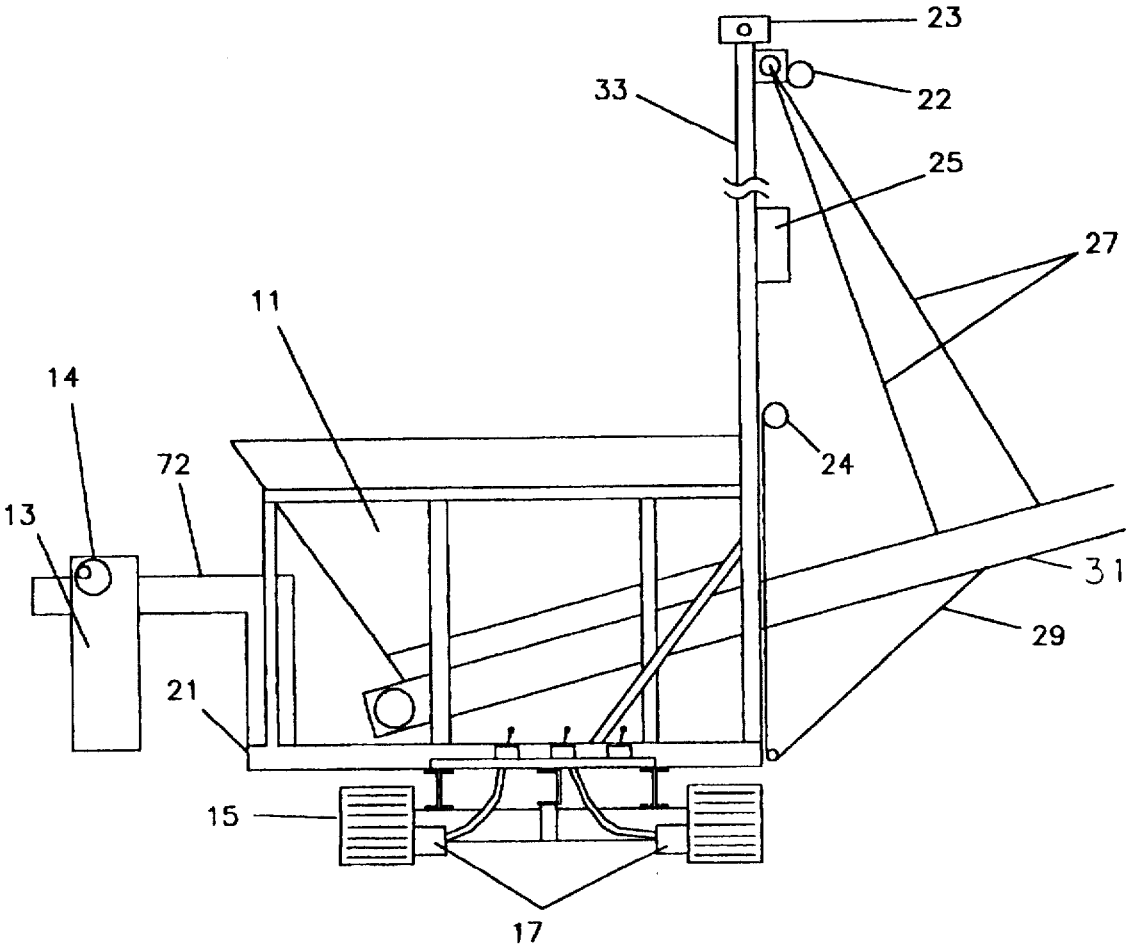
FIG. 3 a front end view of the hopper-spreader.

FIG. 3 shows a front end view of the hopper-spreader unit with all numbers indicating parts as previously described under FIG. 2.

Figure 4:
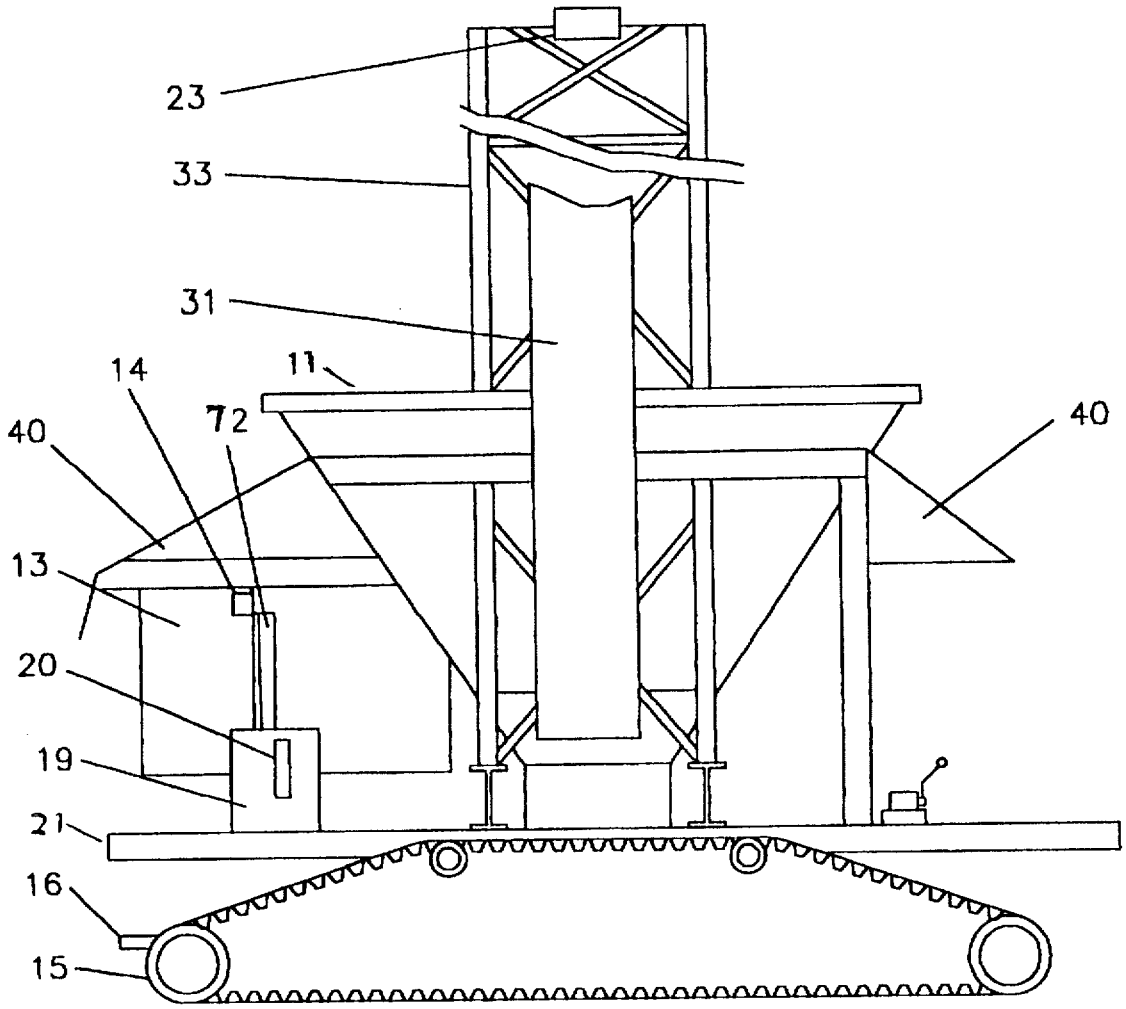
FIG. 4 shows a right side view of the hopper-spreader.

FIG. 4 shows a right side view of the hopper-spreader. No. 15 shows one of the dual hydraulically driven dual tracks but other drive modes would also be feasible. Step 16 is mounted to frame 21 to allow an operator to stand on step 16 if necessary to use manual over ride controls on panel 20. No. 19 shows a vented cover for an internal combustion engine to drive an hydraulic pump to furnish hydraulic power to operate the numerous wireless driven controls covered in more detail in FIG. 5. Counter weight 13 is mounted on an L shaped post 72 that is integrally connected to rigid frame 21 and is movable by hydraulic motor 14 to balance the weight of conveyor 31 and hopper 11 when these units are either loaded or empty. A partial roof 40 provides some weather protection for equipment. Conveyor support rack 33 is used to mount adjustable conveyor support cables 27 and camera 23 as discussed under FIG. 2.

FIG. 5 shows an operator control panel 45 that is mounted adjacent to an operator seat (not shown) in excavator 1, FIG. 1. On panel 45 there is a TV screen 46 to receive pictures continuously from camera 23 mounted on the mobile hopper-spreader, FIG. 2. Each of the remaining controls on panel 45 comprises a labeled push button switch with a light adjacent to the switch that is green when the switch is closed or activated and red when the switch is in the "off" position. In the "on" position the proper signal is broadcast and picked up by receivers and output signals in box 25 mounted on hopper-spreader 1, FIG. 2.

Push button switch 47 starts the internal combustion engine on the hopper-spreader; switch 48 starts hopper-spreader moving forward at a slow speed when "on" and stops forward motion when "off". Push button switch 53 stops the internal combustion engine and therefor all power to the hopper-spreader when pushed to an "off" position. Push button switch 55 causes the hopper spreader to move backward. Push button switch 50 causes the hopper-spreader to move about 10 degrees toward the left; push button switch 49 causes the hopper-spreader to move about 10 toward the right and in both cases the straight forward path is resumed when either switch is turned off. Switch 59 causes the hopper-spreader to move maximum right and switch 61 causes the unit to move the maximum toward the left. Switch 63 is held in to cause the unit to slow down and new speed is held when switch 63 is released. In the same manner 65 resets the forward speed.

Button 64 is held down to move counter weight 13 inward and with release of the button the weight stays in one place. In the same manner button 66 moves the counter weight outward.

Button 69 stops the conveyor. Button 73 raises the conveyor slowly as long as the button is depressed and holds the conveyor in position when the button is released. Button 75 operates similarly to button 73 to lower the conveyor.

What is claimed is:

1. Equipment to excavate and refill soil comprising:

a) an excavator, b) a self propelled hopper-spreader, c) a wireless interconnection means between said excavator and said self propelled hopper-spreader to allow an operator of said excavator to control movement and operation of said hopper-spreader, said wireless interconnection means comprising a control panel mounted on said excavator and a receiver panel mounted on said hopper-spreader; said control panel having a TV screen therein and control buttons; with activation of each of said buttons broadcasting a separate signal to said receiver panel mounted on said hopper-spreader; said hopper-spreader having associated equipment to carry out said operation indicated by each of said signals;

c) said operations, each activated by one of said control buttons, include:

1. starting a motor to operate a hydraulic system that furnishes power for each operation of said hopper-spreader,
2. stopping said motor,
3. starting forward motion of said hopper-spreader,
4. backing up said hopper-spreader,
5. turning said hopper-spreader hard left,
6. turning said hopper-spreader hard right,
7. increasing forward speed of said hopper-spreader,
8. decreasing forward speed of said hopper-spreader,
9. turning said hopper-spreader about 10 degrees left,
10. turning said hopper-spreader about 10 degrees right,
11. lowering a conveyor on said hopper-spreader,
12. raising said conveyor,
13. adjusting a counter weight mounted on said hopper-spreader to prevent tipping of said hopper-spreader;

d) A TV camera mounted on said hopper-spreader broadcasting to a receiver on said excavator to furnish an operator of said excavator a continuous visual picture of operation of said hopper-spreader.

2. A wireless interconnection means between an excavator and a self-propelled hopper-spreader, said hopper-spreader having a conveyor operatively associated therewith, said wireless interconnection means comprising:

a) a control panel mounted in an excavator in a position to be operable by an operator with said control panel having a TV screen therein and a plurality of control buttons; with activation of each of said buttons broadcasting a separate signal;

b) a receiver panel mounted on a hopper-spreader to receive a respective signal from each of said buttons on said excavator with associated equipment to carry out operations indicated by each of said signals;

c) said operations, each activated by a respective one of said control buttons, include:

1. starting a motor to operate a hydraulic system that furnishes power for each operation of said hopper-spreader,
2. stopping said motor,
3. starting forward motion of said hopper-spreader,
4. backing up said hopper-spreader,
5. turning said hopper-spreader hard left,
6. turning said hopper-spreader hard right,
7. increasing forward speed of said hopper-spreader,
8. decreasing forward speed of said hopper-spreader,
9. turning said hopper-spreader about 10 degrees left,
10. turning said hopper-spreader about 10 degrees right,
11. lowering said conveyor on said hopper-spreader,
12. raising said conveyor,
13. adjusting a counter weight mounted on said hopper-spreader to prevent tipping of said hopper-spreader.

* * * * *